US007883086B2

(12) United States Patent
Kamiya

(10) Patent No.: US 7,883,086 B2
(45) Date of Patent: Feb. 8, 2011

(54) SHEET STACKING APPARATUS, SHEET PROCESSING APPARATUS, AND IMAGE FORMING APPARATUS

(75) Inventor: Daisaku Kamiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/268,654

(22) Filed: Nov. 11, 2008

(65) Prior Publication Data

US 2009/0127772 A1 May 21, 2009

(30) Foreign Application Priority Data

Nov. 19, 2007 (JP) ..... 2007-299898

(51) Int. Cl.
*B65H 39/02* (2006.01)

(52) U.S. Cl. ..... 271/220; 271/221; 271/223; 270/58.08; 270/58.12

(58) Field of Classification Search ..... 271/220, 271/221, 223; 270/58.08, 58.12
See application file for complete search history.

(56) References Cited

U.S. PATENT DOCUMENTS 4,905,055 A * 2/1990 Higaki ..... 399/410
5,013,021 A * 5/1991 Johdai et al. ..... 270/58.12
5,229,812 A * 7/1993 Toyama et al. ..... 355/50
5,478,062 A * 12/1995 Horiuchi et al. ..... 270/58.08
7,017,901 B2 * 3/2006 Shiraishi et al. ..... 271/220
7,021,616 B2 4/2006 Mizuta et al.
7,207,556 B2 * 4/2007 Saitoh et al. ..... 270/58.08
7,293,766 B2 * 11/2007 Ruthenberg et al. ..... 270/37
7,331,573 B2 2/2008 Mizuta et al.
7,568,688 B2 * 8/2009 Nomura et al. ..... 270/58.12
2006/0120784 A1 * 6/2006 Iida et al. ..... 399/407
2007/0057427 A1 3/2007 Kamiya et al.
2007/0060459 A1 3/2007 Hayashi
2007/0278732 A1 * 12/2007 Kitahara ..... 270/58.08
2008/0063451 A1 3/2008 Kamiya et al.
2008/0099974 A1 * 5/2008 Nomura et al. ..... 270/58.12

FOREIGN PATENT DOCUMENTS

JP 2007-76793 A 3/2007

* cited by examiner

*Primary Examiner*—Kaitlin S Joerger
(74) *Attorney, Agent, or Firm*—Fitzpatrick, Cella, Harper & Scinto

(57) ABSTRACT

Typical configurations of a sheet stacking apparatus, a sheet processing apparatus, and an image forming apparatus according to the present invention includes a discharging unit which discharges a sheet; a stacking member which stacks a discharged sheet; and a holding unit which is movably disposed along a stacking surface of the stacking member and holds an upstream end in the discharging direction of a stacked sheet, wherein the holding unit is moved according to changes in the upstream end position of the sheet in the discharging direction.

18 Claims, 17 Drawing Sheets

SHEET STACKING APPARATUS, SHEET PROCESSING APPARATUS, AND IMAGE FORMING APPARATUS

BACKGROUND OF THE INVENTION

1. Field of the Invention

The present invention relates to a sheet stacking apparatus which stacks a sheet, a sheet processing apparatus which processes a sheet stacked in the apparatus, and an image forming apparatus having the above apparatuses.

2. Description of Related Art

Conventionally, some of image forming apparatuses which form an image on a sheet have included a sheet processing apparatus which bundles, binds and folds sheets, on which an image is formed in the main body of the apparatus, to make a booklet. The sheet processing apparatus receives sheets one by one into a tray, and bundles them for alignment. The sheets are bound at the vicinity of the center portion, and the center portions are pierced with an extruding member and are pushed into a nip between a pair of folding rollers. The sheet bundle is conveyed with the pair of folding rollers for folding (Refer to Japanese Patent Application Laid-Open No. 2007-076793).

Operations of such a conventional sheet processing apparatus is described based on FIG. 16. As illustrated in FIG. 16, the sheet processing apparatus first aligns a plurality of sheets at a storage guide 803, and, then, the center portion in the conveying direction is bound with a staple. Subsequently, the center portion of the sheet bundle P is pierced with an extruding member 830, and the extruding member 830 is pushed into a nip between a first pair of folding rollers 810*a* and 810*b*. The first pair of folding rollers 810*a* and 810*b*, fold the sheet bundle, while conveying the bundle for temporal stopping.

Then, the folded portion is nipped between a second pair of folding rollers 812*a* and 812*b*, which is different from the first pair of folding rollers 810*a* and 810*b*, and the second folding rollers 812*a* and 812*b* are moved along a crease of the sheet in the orthogonal direction to the conveying direction for reinforcement processing of a fold portion. Consequently, the sheet bundle becomes a sheet bundle folded in the middle (hereinafter, simply called "fold sheet bundle"). Subsequently, the fold sheet bundle is conveyed and discharged into a fold bundle tray 840.

Recently, the picture-quality level of the image forming apparatus has been improved, and the kinds of sheet on which an image is formed has been also diversified. For example, a surface-finished special sheet such as a piece of coated paper, and a sheet with abroad range of grammage (inelastic thin paper, and flexible thick paper) can be printed.

However, when an inelastic sheet is aligned and stacked, there will be caused a possibility that a preceding sheet P1, which has already been stacked, and a subsequent sheet P2, which will be conveyed, are conveyed together by a conveying roller 804 as illustrated in FIG. 17 to cause buckling, and defective conveying and defective alignment of the subsequent sheet.

Moreover, in a vertical-path alignment configuration in which a sheet is aligned by a processing tray in which the downstream side in the discharging direction is inclined low, there will be a fear that buckling of an inelastic sheet is caused by its own weight to cause defective conveying and defective alignment of the subsequent sheet. Though there will be considered an idea that a stacking portion of a sheet is made almost horizontal in such a way that there will be no influence by its own weight, there will be a problem in which the size of the apparatus in the lateral direction is made large, and the installation area of the apparatus is increased.

Then, the present invention provides a sheet stacking apparatus, a sheet processing apparatus, and an image forming apparatus, by which various kinds of sheets such as inelastic sheets can be processed without defective conveying and defective alignment.

SUMMARY OF THE INVENTION

In order to solve the above problems, a typical configuration of a sheet stacking apparatus, a sheet processing apparatus, or an image forming apparatus according to the present invention has the following configuration in which there are included: a discharging unit which discharges a sheet; a stacking member which stacks a discharged sheet; and a holding unit which is movably disposed along a stacking surface of the stacking member, and which holds the upstream end of a stacked sheet in the discharging direction;

wherein the holding unit is moved according to changes in the position of the upstream end of the sheet in the discharging direction.

According to the present invention, there can be excellent stacking and processing of various kinds of sheets such as inelastic sheets without defective conveying and defective alignment.

Further features of the present invention will become apparent from the following description of exemplary embodiments (with reference to the attached drawings).

DESCRIPTION OF THE EMBODIMENTS

First Embodiment

A sheet stacking apparatus, a sheet processing apparatus, and an image forming apparatus according to a first embodiment of the present invention is described using drawings.

(Image Forming Apparatus)

Figure 2:
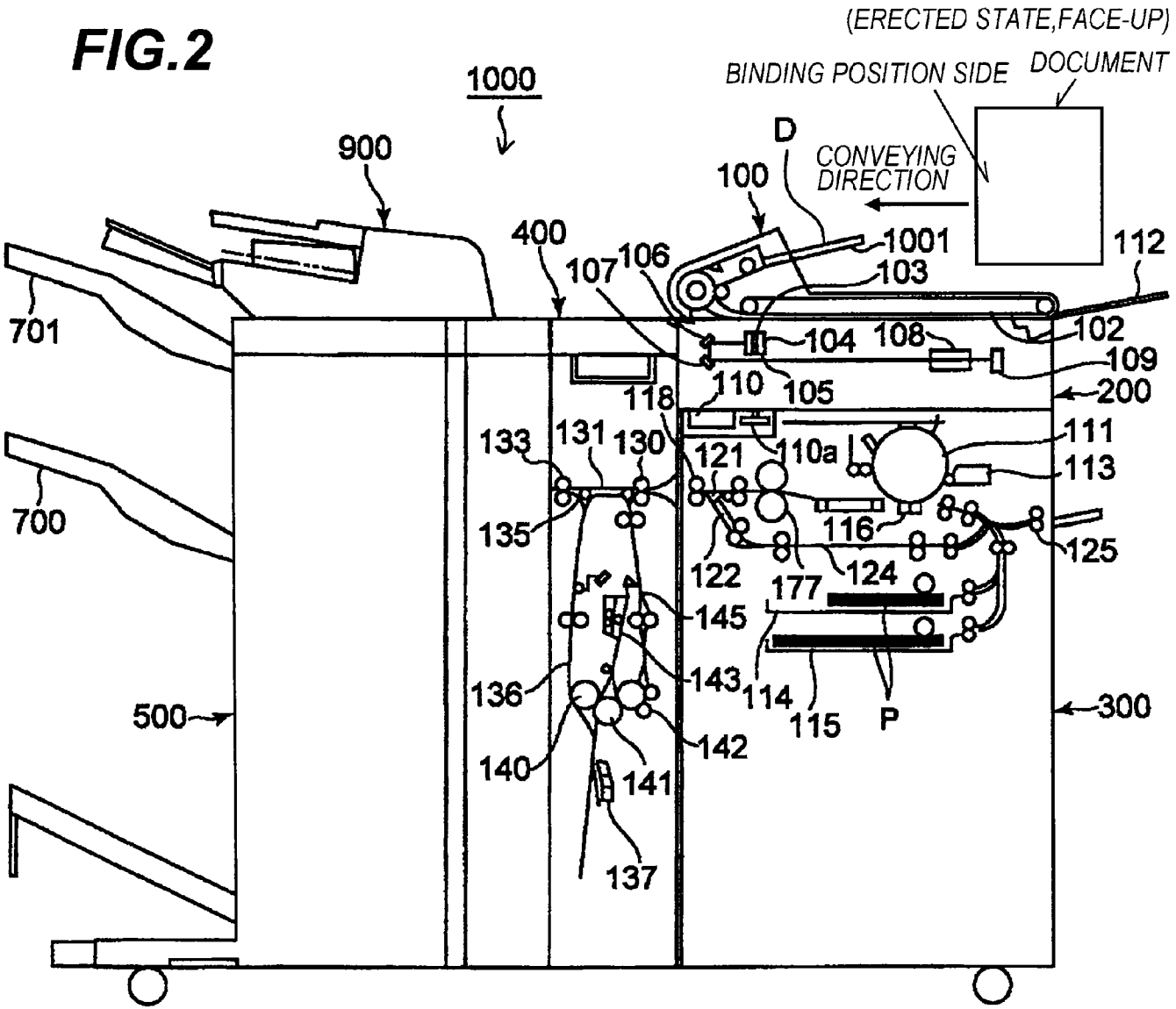
FIG. 2 is a configuration diagram of an image forming apparatus.

FIG. 2 is a cross-section diagram of an image forming apparatus according to the present embodiment. As illustrated in FIG. 2, a copying machine 1000 as an image forming apparatus has a document feeding portion 100, an image reading portion 200, a printing portion 300, a folding processing portion 400, a finisher (sheet post-processing apparatus) 500, and a inserter 900. The folding processing portion 400 and the inserter 900 can be provided as an option.

A document is set in a face-up state (a surface on which an image is formed is in an upward state) on a tray 1001 in the document feeding portion 100. The binding position of the document is assumed to be at a left end portion of the document. The documents set on the tray 1001 are sequentially conveyed from the first page one by one by the document feeding portion 100 in the left direction, that is, in a state that the binding position is at the head. Then, the document is conveyed on a platen glass 102 from the left to the right passing through a curved path, and, subsequently, is discharged onto a discharge tray 112. At this time, a scanner unit 104 is stopped at a predetermined document reading position.

The scanner unit 104 reads an image on a document passing from the left to the right on the scanner unit 104. The method for reading a document is called "skimming". When a document passes on the platen glass 102, the document is irradiated by a lamp 103 in the scanner unit 104. The reflected light from the document is guided to an image sensor 109 through mirrors 105, 106, 107, and a lens 108.

Moreover, the image reading portion 200 can perform reading processing of a document by a configuration in which a document is temporarily stopped on the platen glass 102, and, while the above state is kept, the scanner unit 104 is moved from the left to the right by the document feeding portion 100. The reading method is called "reading in stopping". When a document is read without using the document feeding portion 100, a user sets the document on the platen glass 102 by opening and closing the document feeding portion 100. Subsequently, the scanner unit 104 performs "reading in stopping" of the document.

Predetermined image processing for the image data of the document read by the image sensor 109 is performed, and the data is sent to an exposure controlling portion 110. The exposure controlling portion 110 outputs laser light according to an image signal. The laser light is irradiated on a photosensitive drum 111, while being scanned by a polygon mirror 110*a*. An electrostatic latent image corresponding to the scanned laser light is formed on the photosensitive drum 111.

The electrostatic latent image formed on the photosensitive drum 111 is developed by a development device (image forming member) 113, and is visualized as a toner image. On the other hand, a sheet (recorded paper) P is conveyed to a transfer portion 116 from any one of cassettes 114, 115, a manual feeding portion 125, and a duplex conveying path 124. Then, a visualized toner image is transferred on a sheet in the transfer portion 116. The toner image is fixed on the transferred sheet in a fixing portion 177. The photosensitive drum 111 and the development device 113 form an image forming unit.

Moreover, the sheet passing through the fixing portion 177 is once guided to a path 122 by a switching member 121. When a trailing end of the sheet passes through the switching member 121, there is executed switching-back conveying of the sheet, and the sheet is guided to the discharge roller 118 by the switching member 121. The sheet is discharged from the printing portion 300 by the discharge roller 118. Accordingly, the sheet is discharged from the printing portion 300 in a state (face-down) in which the surface on which a toner image is formed is downward. The operations are called "reversed discharging".

When a sheet is discharged to the outside of the unit in the face-down state, image forming processing can be sequentially performed from the head page. When the image forming processing is performed using, for example, the document feeding portion 100, or when there is executed image forming processing of image data from a computer, the order of pages can be arranged.

Moreover, when an image is formed on both sides of a sheet, the printing portion 300 guides the sheet from the fixing portion 177 directly to the discharge roller 118. Then, switch-back conveying of the sheet is performed immediately after the trailing end of the sheet has passed through the switching member 121, and the sheet is guided to the duplex conveying path 124 by the switching member 121.

(Folding Processing Portion 400)

Figure 1:
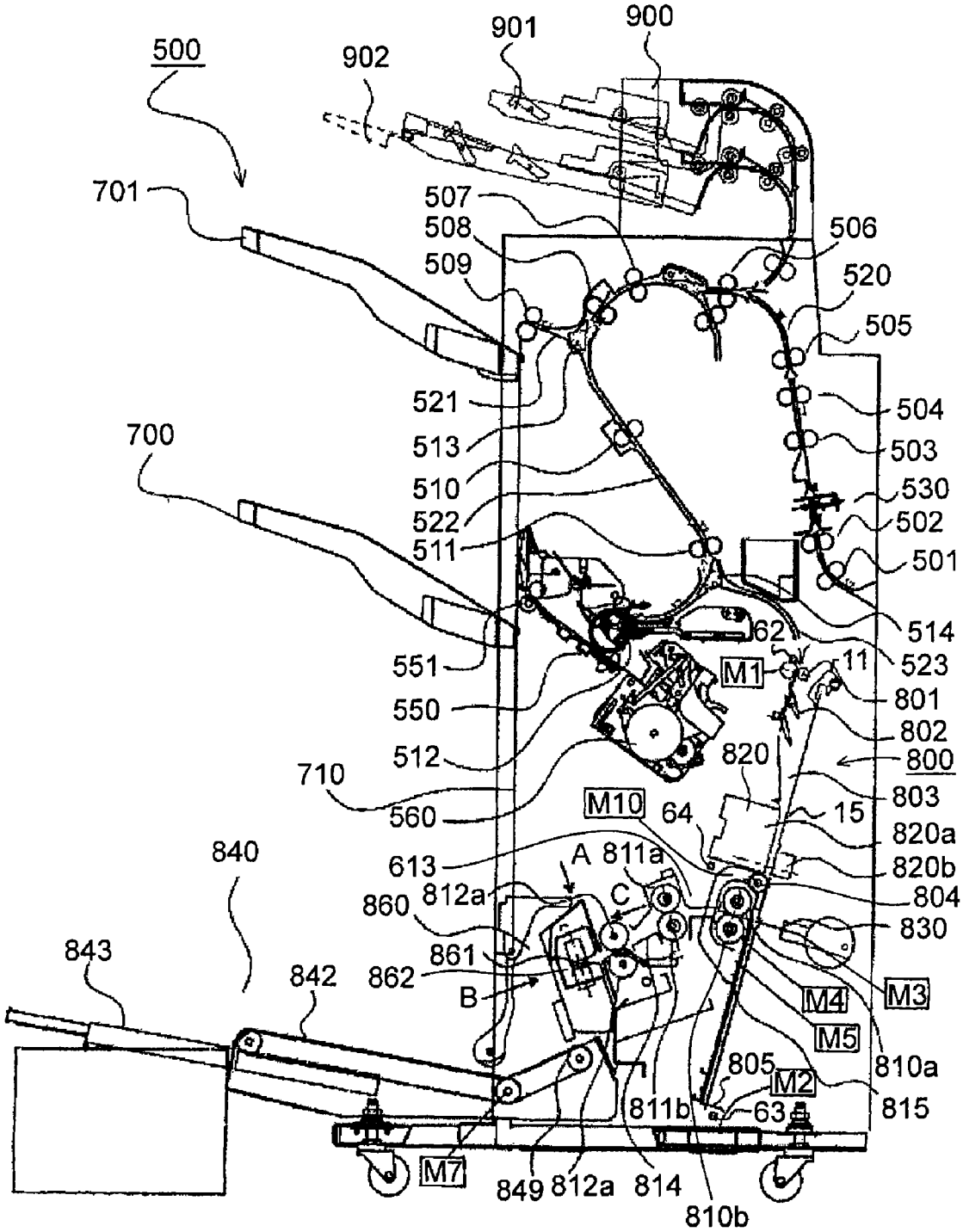
FIG. 1 is a configuration diagram of a sheet post-processing apparatus provided with a sheet processing apparatus according to a first embodiment.

Then, the configurations of the folding processing portion 400 and a finisher 500 is described based on FIG. 1 and FIG. 2. FIG. 1 is a cross-section diagram of the finisher 500.

In FIG. 2, the folding processing portion 400 is provided with a conveying path 131 which accepts a sheet discharged from the printing portion 300, and guides the sheet to the finisher 500 side. The conveying path 131 is provided with the pair of conveying rollers 130 and the pair of discharge rollers 133. Moreover, a switching member 135 provided in the vicinity of the pair of discharge rollers 133 guides a sheet conveyed by the pair of the conveying rollers 130 to the side of a fold path 136 or to the side of the finisher 500.

When folding processing of a sheet is performed, the switching member 135 is changed to the side of the fold path 136 to guide the sheet to the fold path 136. The tip end of the sheet conveyed to the fold path 136 is made to collide with a stopper 137 to form a loop, and, then, is folded by folding rollers 140 and 141. The loop formed by colliding between the folded portion and the upper stopper 143 is further folded by the folding rollers 141 and 142, and Z-folding of the sheet is realized. The Z-folded sheet is guided through the conveying paths 145 and 131, and is discharged to the finisher 500 by the pair of discharge rollers 133. Moreover, the folding processing operation by the folding processing portion 400 is selectively executed.

When the folding processing is not executed, the switching member 135 is switched to the side at which the sheet is guided to the finisher 500. The sheet discharged from the printing portion 300 passes through the conveying path 131 and the switching member 135, and is sent directly to the finisher 500.

(Finisher 500)

The finisher 500 aligns a plurality of sheets conveyed from the printing portion 300 through the folding processing portion 400 for sheet processing. The sheet processing includes processing by which sheets are bundled as one sheet bundle; staple processing (binding processing) by which the trailing end side of a sheet bundle is stapled; sorting processing; and non-sorting processing.

As illustrated in FIG. 1, the finisher 500 has a conveying path 520 by which the sheet conveyed through the folding processing portion 400 is fetched into the apparatus. Pairs of conveying rollers 502 through 508 are sequentially provided on the conveying path 520 from the pair of entrance rollers 501 toward the downstream side in the sheet conveying direction.

A punch unit 530 is provided between the pair of conveying rollers 502 and 503. The punch unit 530 is operated if necessary, and a hole is made (punching processing is performed) at the trailing end portion of the sheet to be conveyed.

A switching member 513 provided at the terminal of the conveying path 520 switches a route into an upper discharging path 521 and a lower discharging path 522 linked to the downstream. The upper discharging path 521 guides a sheet to a sample tray 701 by the upper discharge roller 509. On the other hand, a pair of conveying rollers 510, 511, and 512 are provided on the lower discharging path 522. The pair of conveying rollers 510, 511, and 512 convey and discharge a sheet to the processing tray 550.

Figure 12:
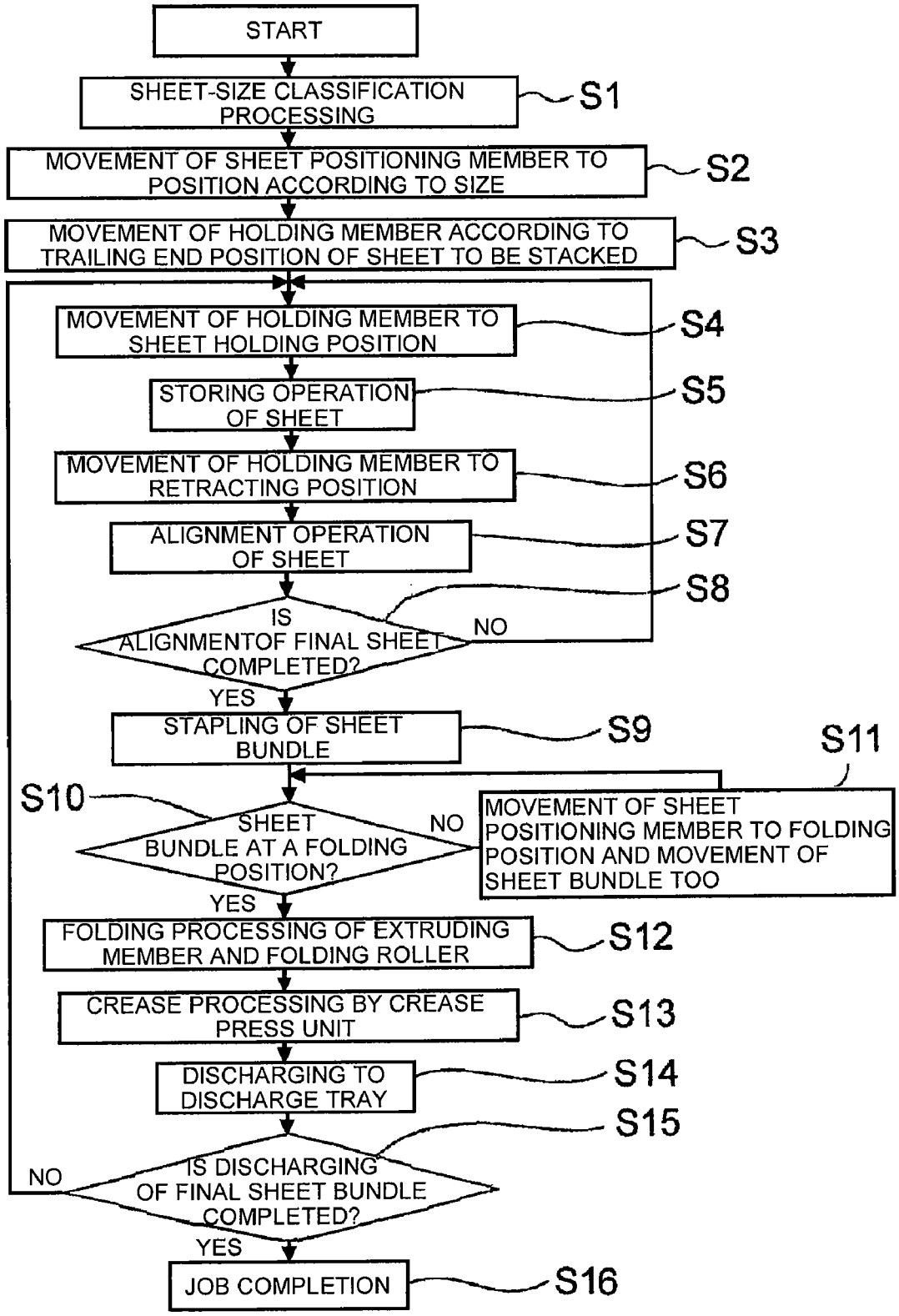
FIG. 12 is a flow chart of a post-processing apparatus.

While sequential alignment processing of a sheet discharged to the processing tray 550 is performed one by one, sheets are stacked like a bundle, and sorting processing and staple processing are performed according to setting from the operation portion 1 (FIG. 12). The processed sheet bundle is selectively discharged to a stack tray 700 or the sample tray 701 by a pair of bundle discharge rollers 551.

Here, the staple processing is performed by a stapler 560. The stapler 560 is moved in the width direction of the sheet (in the intersecting direction to the sheet conveying direction), and an arbitrary portion of a sheet bundle is bound. The stack tray 700 and the sample tray 701 move up and down along the main body of the device of the finisher 500. The upper sample tray 701 receives sheets from the upper discharging path 521 and the processing tray 550. Moreover, the stack tray 700 at the lower side receives sheets from the processing tray 550. Thus, a large volume of sheets are stacked in the stack tray 700 and the sample tray 701. The trailing end of a stacked sheet is caught by the trailing end guide 710 extending in the vertical direction, and the stacked sheets are aligned.

(Center-Binding Book-Forming Portion 800)

Next, a configuration of a center-binding book-forming portion 800 as a sheet processing apparatus is described.

Here, processing by which a sheet bundle is folded by a pair of folding rollers 810 and an extruding member 830 is called folding processing in the following description. Moreover, processing by which a crease is put on the processed sheet bundle by a pair of press rollers 861 is called crease reinforcement processing.

A switching member 514 provided on the way of the lower discharging path 522 switches a sheet to the right side and guides the sheet to a saddle discharging path 523 and to the center-binding book-forming portion 800.

A pair of saddle entrance rollers 801 (discharging unit), a switching member 802, a storage guide (stacking member) storing a sheet 803, a conveying roller (conveying unit) 804, and a sheet positioning member 805 are sequentially disposed from the entrance of the center-binding book-forming portion 800. The storage guide 803, the conveying roller 804, and the sheet positioning member 805 form a sheet stacking apparatus.

The switching member 802 is operated by a solenoid according to the size of a sheet. As will be described later, the storing position of a sheet stored in the storage guide 803 is set in such a way that movement to a sheet processing position after storing is made minimum. Accordingly, the trailing end position of a sheet to be stored is also changed according to the size of the sheet.

Above the storage guide 803 inclined in such a way that the downstream side in the discharging direction is inclined low (75° to the horizontal direction in FIG. 1), a holding unit 11 which holds the upstream end of a stacked sheet in the discharging direction is provided. The holding unit 11 is movably disposed along a sheet stacking surface 15 of the storage guide 803 according to changed (trailing end) positions of the upstream end in the discharging direction of the stacked sheet.

The pair of saddle entrance rollers 801 and the conveying roller 804 are rotated by a conveying motor M1. The conveying roller 804 is supported by a not-shown driving source, and, at predetermined timing, can be abutted against the sheet and can be separated from the sheet. While the conveying roller 804 is abutted against a discharged sheet, the holding unit 11 holds the upstream end (trailing end) of the sheet already stacked in the discharging direction.

On the way of the storage guide 803, staplers (binding members) 820 are opposedly arranged. The storage guide 803 is between staplers 820. The stapler 820 is provided with a driver 820*a* which thrusts out a staple, and an anvil 820*b* which folds the thrust-out staple.

The sheet positioning member 805 can catch the tip end (downstream end in the discharging direction) of the discharged sheet, and the sheet can be moved along the sheet stacking surface 15 of the storage guide 803 by the sheet positioning member 805 in such a way that staple processing can be performed at a predetermined processing position in the sheet discharging direction. The sheet positioning member 805 is moved up and down by a member moving motor M2 in such a way that a predetermined processing position on the sheet agrees with the binding position of the stapler 820, aligns the position, and stops at a position corresponding to the size of the sheet. In the present embodiment, the predetermined processing position on the sheet is described as a center portion in the sheet discharging direction.

Figure 3:
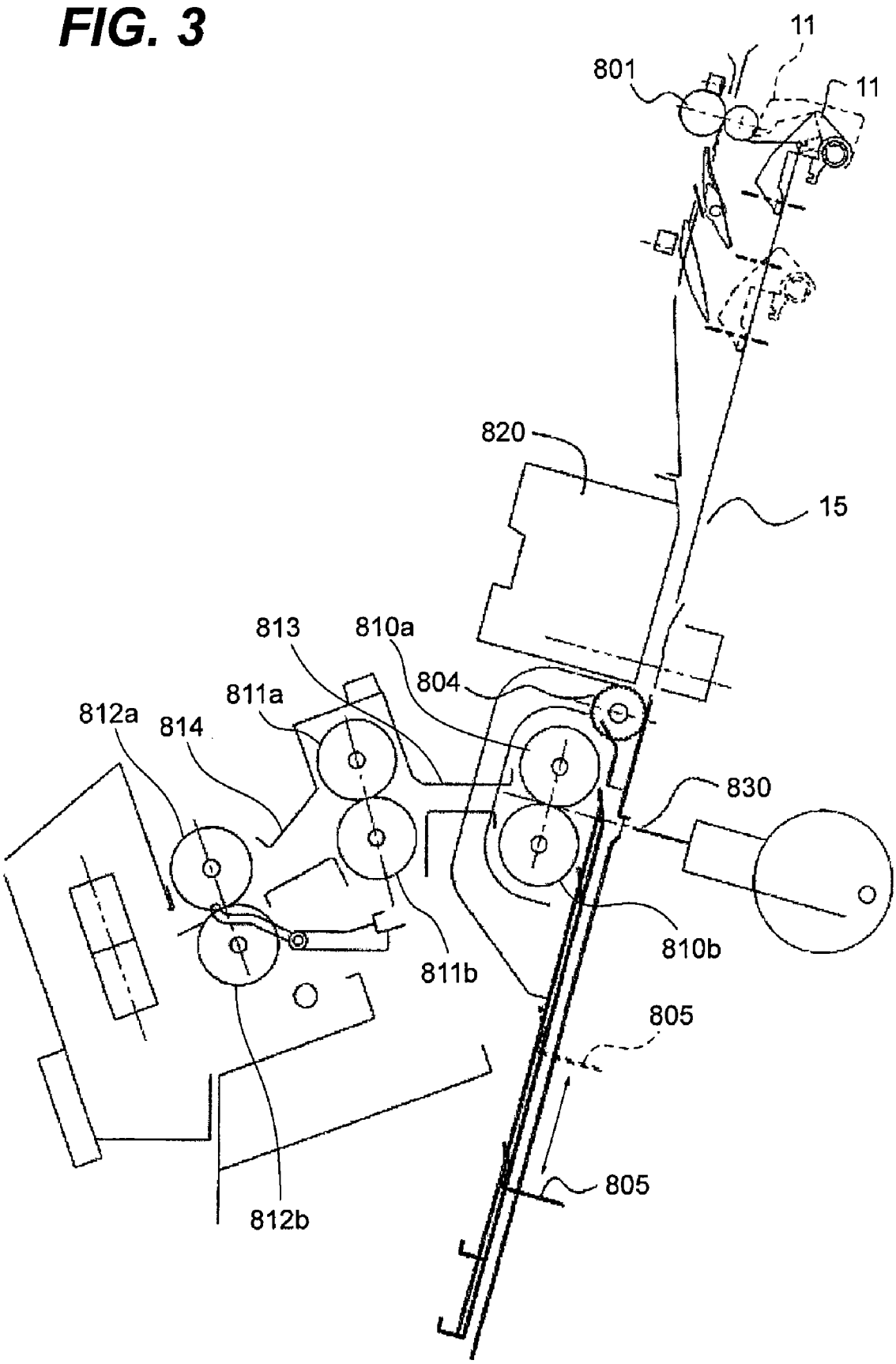
FIG. 3 is a configuration diagram of a sheet processing apparatus.

That is, it is meant that the upstream end position of the sheet in the discharging direction depends on the size of the sheet when the sheet is collided with the sheet positioning member 805 and is aligned. As illustrated in FIG. 3, the holding unit 11 can be operated in the vertical direction (conveying direction) in FIG. 3 in such a way that the trailing end of the stacked sheet having a different sheet size can be also held. Moreover, the trailing end positions of the sheets are changed not only by the difference in the sizes of the sheets, but by the difference in the sheet processing position according to the sheet processing mode, for example, by a difference between a binding position of the stapler 820 as a processing unit, and a folding position by the folding portion, and, furthermore, by a difference between processing positions to a sheet.

(Holding Unit 11)

Figure 4:
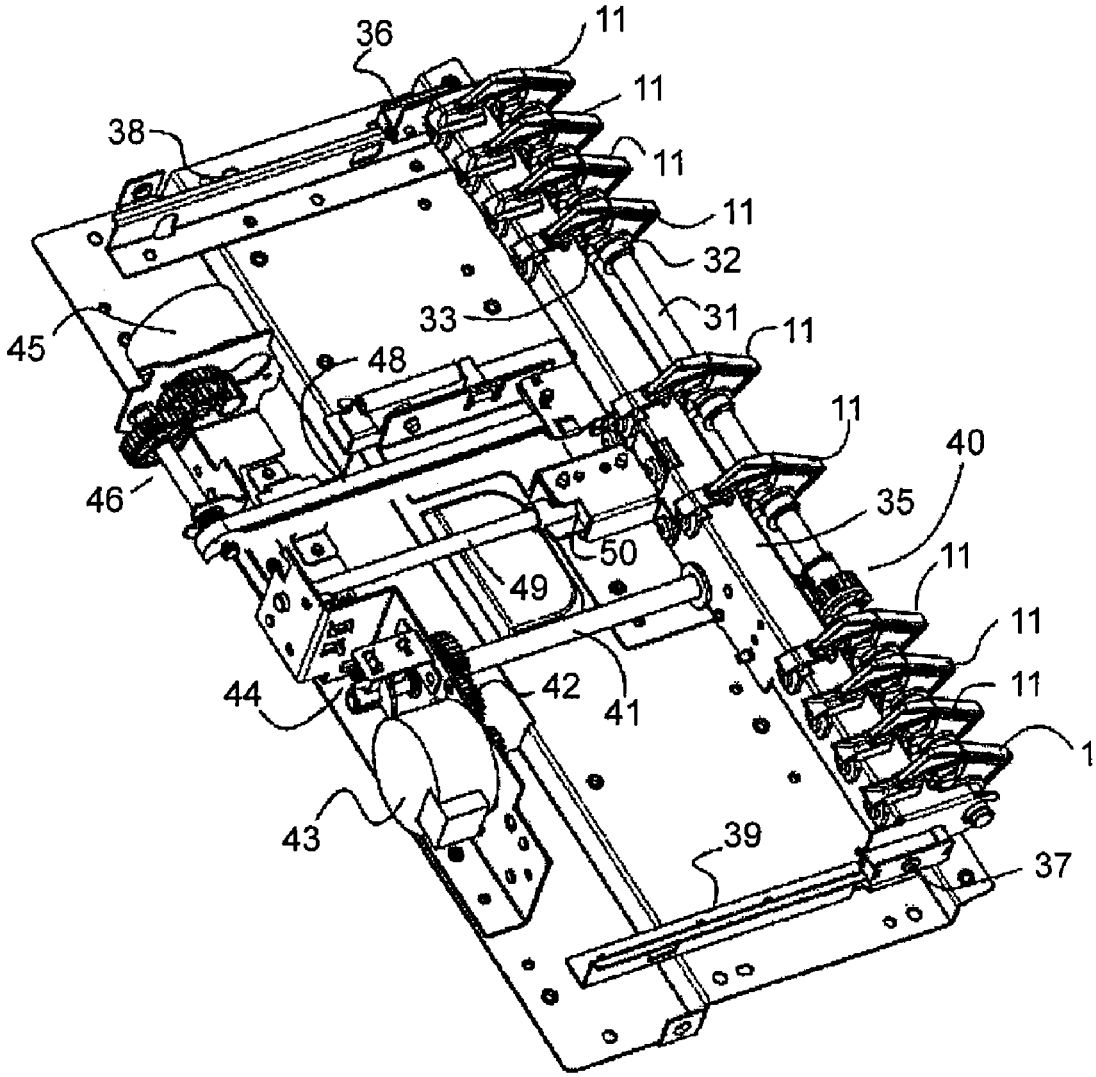
FIG. 4 is a perspective view of the sheet processing apparatus.
Figure 5A:
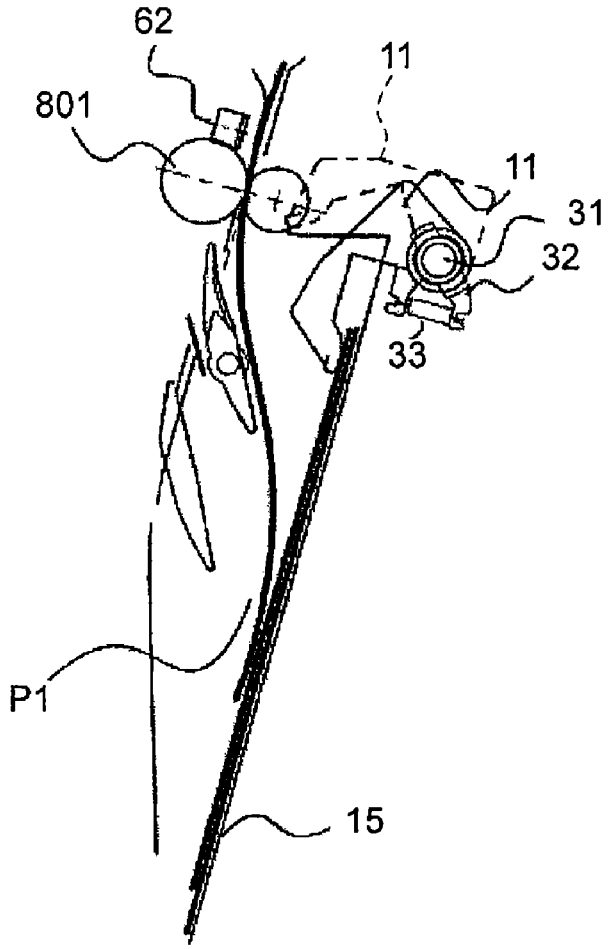
FIG. 5A and FIG. 5B are operation explanatory diagrams of the sheet processing apparatus.
Figure 5B:
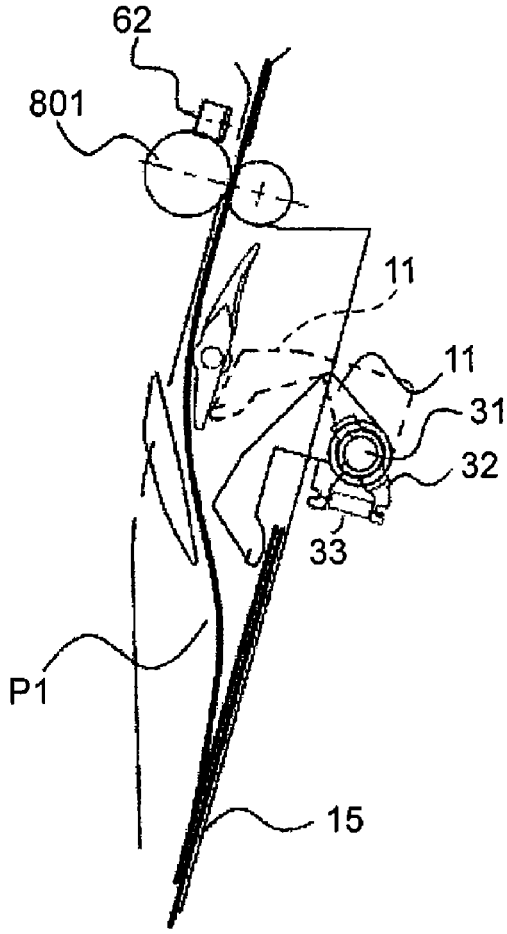

The holding unit 11 is described in detail using FIG. 4 and FIG. 5.

The holding unit 11 is rotatably supported onto a holding keeping member 32 by a predetermined angle, and one end is energized by a holding spring 33. The holding spring 33 is supported onto the holding keeping member 32. The holding keeping member 32 is fixedly provided onto a holding axis 31. The holding axis 31 is rotatably supported onto a supporting member 35.

A holding unit rotation motor 43 gives driving force to a driving gear portion 42, and rotatably drives a driving axis 41. The driving axis 41 rotatably drives a driving portion 40 disposed on the supporting member 35. Accordingly, the holding axis 31 is driven and rotated onto which the driving portion 40 is fixed. A holding unit position detection sensor 44 detects the position of the holding unit 11, and the position of the holding unit 11 which is rotated by the holding unit rotation motor 43 is controlled by the detection.

By rotation of the holding axis 31, the holding unit 11 can be moved from a sheet holding position (solid line in FIG. 5) to a retracting position (broken line in FIG. 5) resisting the energizing force of the holding spring 33. The holding unit 11 gives holding force to the sheet by the spring force of the holding spring 33 at the sheet holding position.

The supporting member 35 is fixedly provided at a slide bush 50 and supported by a moving axis 49 through the slide bush 50 in such a way that the member 35 can be moved by a thrust. A slide bush 36 and 37 are fixed at the both ends of the supporting member 35 in the longitudinal direction. The supporting member 35 is configured to slide on the slide rails 38 and 39 through the slide bushes 36 and 37. A timing belt 48 is fastened to the approximately center portion of the supporting member 35 in the longitudinal direction.

A holding unit moving motor 45 transmits driving force to the timing belt 48 through a driving portion 46. Accordingly, the supporting member 35 fixed to the timing belt 48 is moved along the slide rails 38 and 39. A supporting member position detection sensor 51 detects the position of the supporting member 35, and, the position of the supporting member 35 which is moved by the holding unit moving motor 45 is controlled by the detection.

By moving the supporting member 35, the holding unit 11 can perform rotation operation and moving operation in the conveying direction as shown by broken lines and solid lines in FIG. 3 and FIG. 5.

As illustrated in FIG. 7, the holding unit 11 has a sheet-guide surface 11*a* guiding the sheet, and a sheet holding surface 11*b* which holds the sheet. The sheet guide surface 11*a* is formed by a surface which is intersecting with the sheet stacking surface 15 at an obtuse angle θ (150°). Moreover, in an operation in which sheets are sorted, the pair of saddle entrance rollers 801 are configured to be fixed and only the holding unit 11 is configured to be moved in the conveying direction.

Figures 7A, 7B, 7C:
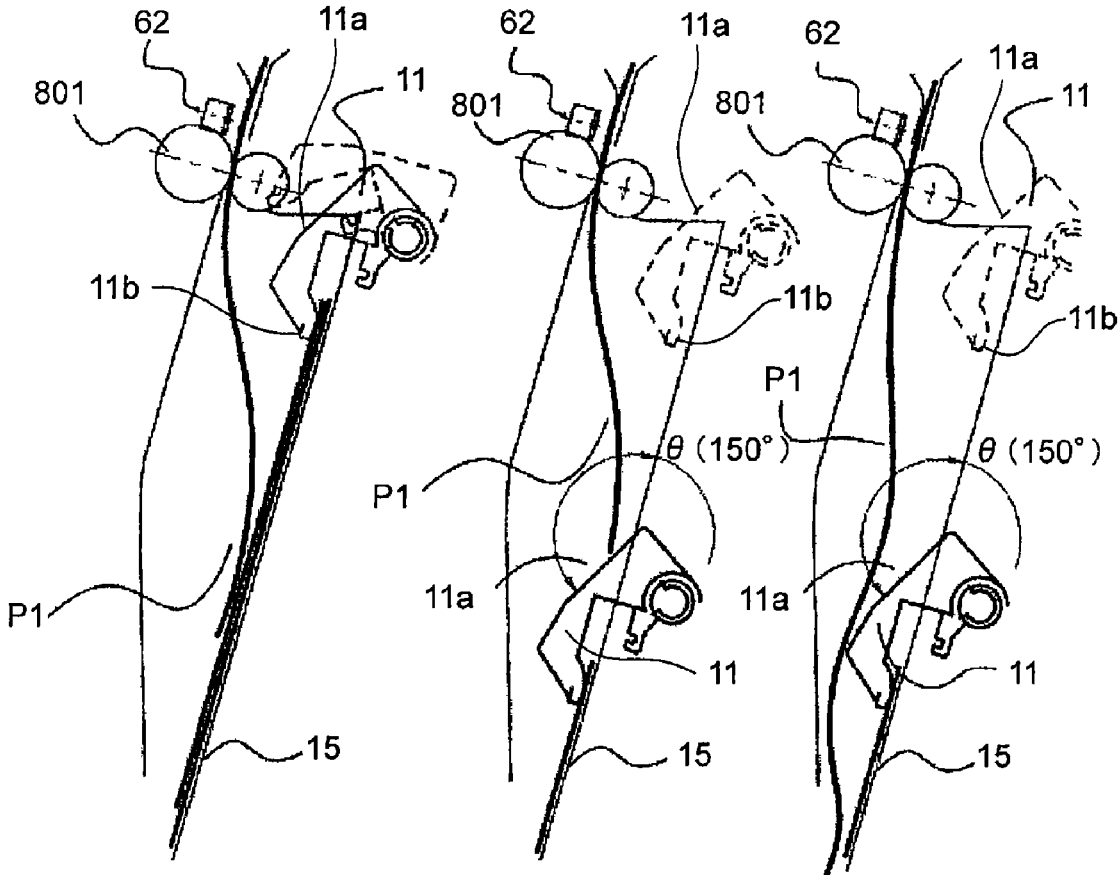
FIG. 7A, FIG. 7B, and FIG. 7C are operation explanatory diagrams of the sheet processing apparatus.

Accordingly, in a large-sized sheet, as illustrated in FIG. 7A, jamming caused by a configuration, in which a conveyed sheet pushes out a sheet which has already been stacked, can be controlled by holding the trailing end of the sheet by the sheet holding surface 11*b*.

Moreover, even in a smaller-sized sheet, the sheet rides over the holding unit 11 without jamming as illustrated in FIG. 7C after the tip end of the sheet is abutted against the sheet guide surface 11*a* as illustrated in FIG. 7B. Consequently, even in a case of a sheet with a smaller size, a sorting operation of sheets can be realized while holding the trailing end of the stacked sheet bundle, in such a way that the trailing end of a stacked sheet does not collide with the tip end of a sheet P1 which is subsequently conveyed. Though, as an example in the present embodiment, there is adopted a configuration in which the sheet-guide surface 11*a* rises from the sheet stacking surface 15 toward the downstream side in the conveying direction at an obtuse angle θ, there may be accepted a configuration in which the sheet guide surface 11*a* may be configured to enter into the sheet stacking surface 15 from the upstream side in the conveying direction at an obtuse angle θ. When an angle between the sheet stacking surface 15 and the sheet guide surface 11*a* is an obtuse angle, a sheet which is conveyed rides over the holding unit 11 without jamming.

Moreover, according to the size of the sheet, there may be considered an idea that the pair of saddle entrance rollers 801 and the holding unit 11 are moved in the conveying direction. However, the configuration may not require a configuration in which, according to the size of a sheet, the pair of saddle entrance rollers 801 is moved in the conveying direction, so that an apparatus with a smaller size can be realized.

(Pair of Folding Rollers 810 and Extruding Member 830)

As illustrated in FIG. 1 and FIG. 3, a pair of folding rollers 810*a* and 810*b* are provided at the downstream side of the stapler 820 as a processing unit. An extruding member 830 is provided at a position opposing the pair of folding rollers 810*a* and 810*b*. The pair of folding rollers 810*a* and 810*b* and the extruding member 830 form a folding portion as a processing unit. Though the book binding processing in the middle, in which folding processing by the folding portion is executed after binding processing by the stapler 820 is described as an example of the sheet processing mode in the present embodiment, there can be also executed a sheet processing mode in which only folding processing is performed without binding processing. In this case, the sheet positioning member 805 is set according to the sheet-processing position by the folding portion.

The extruding member 830 is provided at a position retracted from the storage guide 803 as a home position. The extruding member 830 is extruded toward the stored sheet bundle by driving a motor M3, and the sheet bundle is pushed into the nip between the pair of folding rollers 810*a* and 810*b*. Thereafter, the extruding member 830 returns to the home position again. A pressure F1 enough for folding processing in which a sheet bundle is folded is applied to between the pair of folding rollers 810*a* and 810*b* by a not-shown spring.

The sheet bundle folded by the pair of folding rollers 810 is discharged to a fold bundle tray 840 through a first pair of folding rollers 811*a* and 811*b* and a second pair of folding rollers 812*a* and 812*b*.

Enough pressures F2 and F3 are also applied to between the first pair of folding rollers 811, and also to between the second pair of folding rollers 812 for conveying and stopping of the folded sheet bundle.

A conveying guide 813 guides a sheet bundle between the pair of folding rollers 810 and the first pair of folding rollers 811. A conveying guide 814 guides a sheet bundle between the first pair of folding rollers 811 and the second pair of folding rollers 812. The pair of folding rollers 810, the first pair of folding rollers 811, and the second pair of folding rollers 812 nip the folded pair of sheet bundle from the both surfaces, and are rotated by the same motor M4 (not shown) at an equal velocity.

Folding of sheet bundles bound by the stapler 820 is executed after the sheet positioning member 805 lowers a sheet bundle by a predetermined distance from the position at the staple processing, and the staple position of a sheet bundle coincides with a nip position of the pair of folding rollers 810. Accordingly, a sheet bundle is folded mainly around a (bound) portion to which the staple processing is applied.

A pair of alignment boards 815 executes width alignment of a sheet stored in the storage guide 803. The alignment boards are moved by a motor M5 in a direction in which the sheet is nipped, and the positioning (alignment) of a sheet in the width direction is executed.

A crease press unit 860 as a folding portion processing unit is provided in the downstream of the second pair of folding rollers 812. The crease press unit 860 has a press holder 862, which supports the pair of press rollers 861. In a state that the pair of press rollers 861 nip the folding portion, the crease is reinforced by movement of the press holder 862 in the direction of the crease. A first conveyer belt 849 is disposed just under the crease press unit 860. A sheet bundle is carried from the first conveyer belt 849 to a second conveyer belt 842, and the sheet bundle is stacked on a discharge tray 843 from the second conveyer belt 842.

(Inserter 900)

An inserter 900 provided in the upper portion of the finisher 500 is described based on FIG. 1. The inserter 900 is an apparatus which inserts a sheet (insert sheet) different from a usual sheet to one of the first page, the last page, and a last-off page of a sheet (recording paper), on which an image is formed in the printing portion 300. The insert sheet for the first page and the last page is a sheet for a cover.

The inserter 900 supplies a sheet set in insert trays 901, and 902 by a user to any one of a sample tray 701, a stack tray 700, and a fold bundle tray 840 without passing through the printing portion 300. The inserter 900 sequentially separates sheet bundles stacked on insert trays 901 and 902 one by one, and sends the bundles to the conveying path 520 at a desired timing.

(Control Portion)

Figure 10:
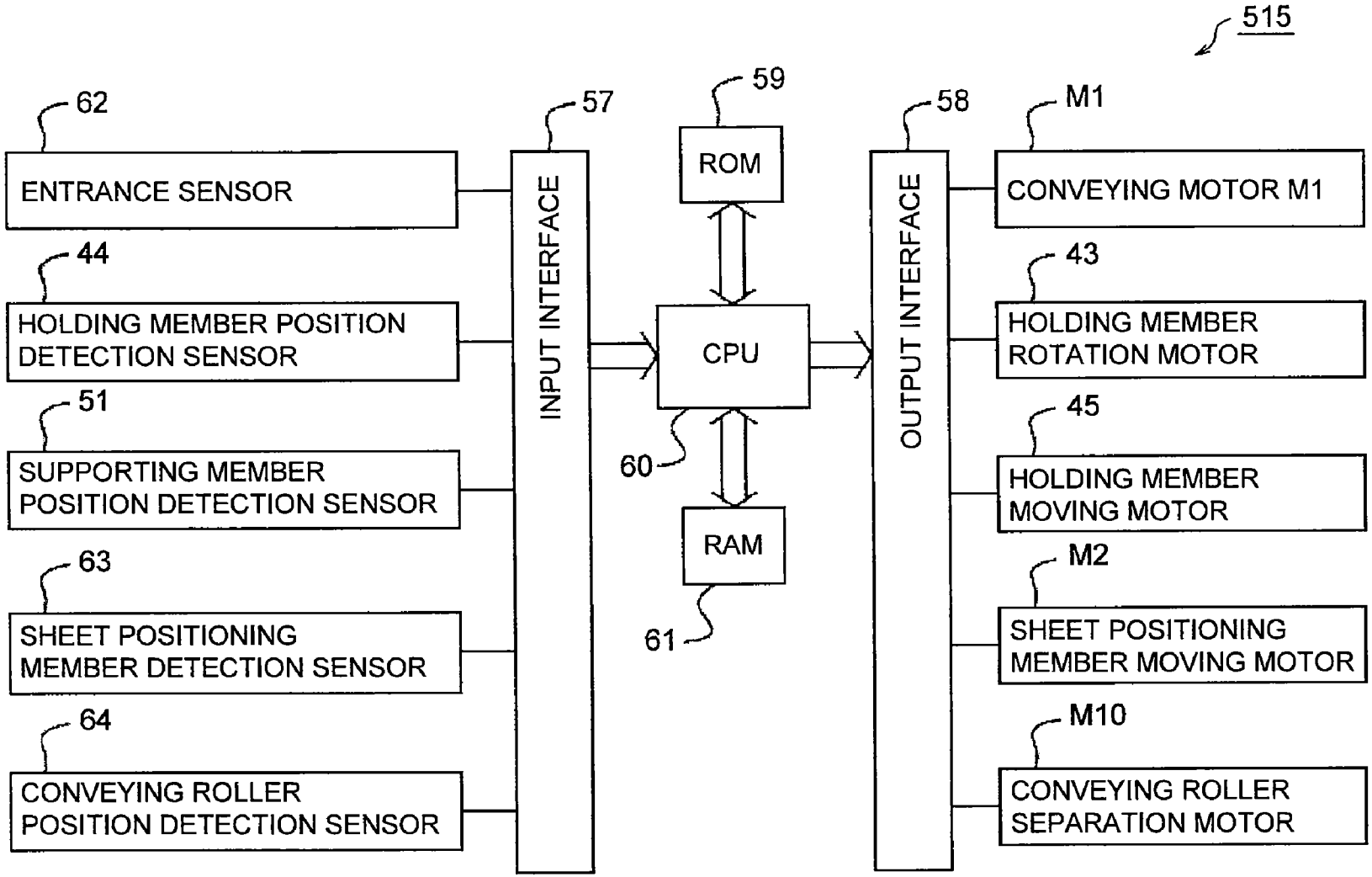
FIG. 10 is a control block diagram for a sheet post-processing apparatus.

FIG. 10 is a function block diagram illustrating a configuration of a finisher control portion 515 in a finisher 500.

The finisher control portion 515 as a control portion includes a microcomputer system, and has CPUs 60, ROMs 59, and RAMs 61. The ROM 59 stores programs for puncher processing, and programs for staple processing beforehand. The CPU 60 executes each program and makes a predetermined control signals by input-data processing while data is properly exchanged between the CPU 60 and the RAM 61.

Detection signals from an entrance detection sensor 62, a holding unit position detection sensor 44, a support member position detection sensor 51, a sheet positioning member detection sensor 63, and a conveying roller position detection sensor 64 are input to the CPU 60 as an input data through an input interface circuit 57.

Various kind of control signals are output from the CPU 60 through an output interface circuit 58. The output signals are transmitted toward control devices such as a motor drivers, and operates the conveying motor M1, the holding unit rotation motor 43, the holding unit movement motor 45, the sheet positioning member moving motor M2, and the conveying roller separating motor M10 by control of the control device. Moreover, data is transmitted and received for communication between a CPU circuit portion 150 (refer to FIG. 11) provided at the side of the main body of an image forming apparatus and the CPU 60 in the finisher 500.

Figure 11:
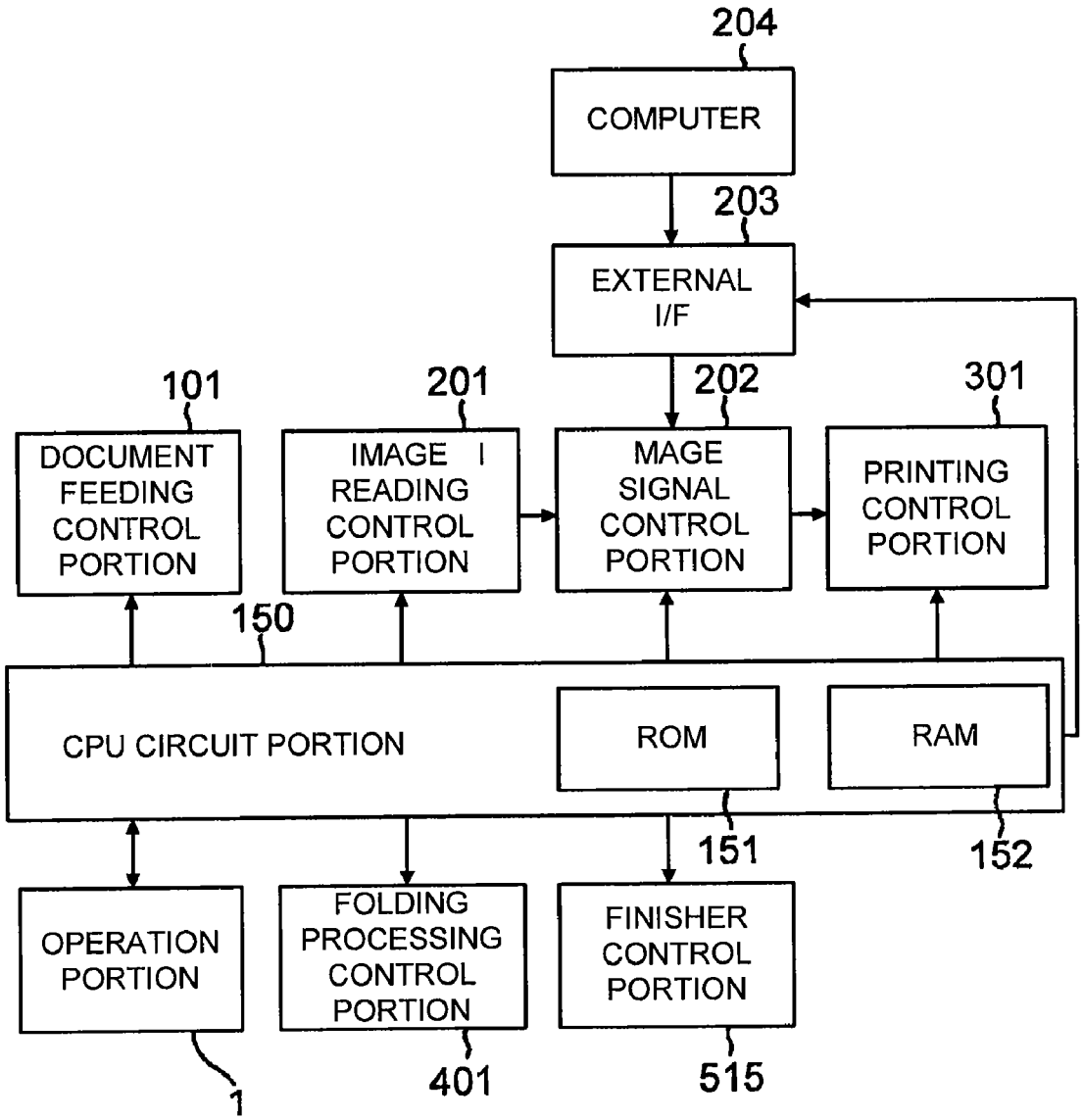
FIG. 11 is a control block diagram for a whole of a copying machine.

FIG. 11 is a control block diagram of a copying machine 1000. A CPU circuit portion 150 has CPUs (not shown). The CPU circuit portion 150 controls a document feeding control portion 101, an image reading control portion 201, an image signal control portion 202, a printing control portion 301, a folding processing control portion 401, a finisher control portion 515, and an outside I/F 203. Control by the CPU circuit portion 150 is based on control programs stored in the ROM 151 and setting of the operation portion 1.

The document feeding control portion 101 controls the document feeding portion 100. The image reading control portion 201 controls the image reading portion 200. The printing control portion 301 controls the printing portion 300. The folding processing control portion 401 controls the folding processing portion 400, respectively. The finisher control portion 515 controls the finisher 500, the center-binding book-forming portion 800, and the inserter 900.

The operation portion 1 has a plurality of keys for setting various kinds of functions related with image forming and a display portion for displaying setting states. The operation portion 1 outputs key signals corresponding to operations of keys by a user to the CPU circuit portion 150, and, at the same time, corresponding information is displayed on the display portion based on signals from the CPU circuit portion 150.

A RAM 152 is used as an area for keeping control data temporarily, and as a working area for control-related operations. The outside I/F 203 is an interface between the copying machine 1000 and the outside computers 204. The print data from the computer 204 are developed into a bit map image, and is output to the image signal control portion 202 as image data. Moreover, an image on a document, which is read with an image sensor (not shown), is output from the image reading control portion 201 to the image signal control portion 202. The printing control portion 301 outputs image data from the image signal control portion 202 to an exposure controlling portion (not shown).

Furthermore, sheet information on a sheet kind (plain paper, coated paper, or special paper) and a sheet size, and related conditions are input from an operation portion (operation panel) 1 in the main body of the image forming apparatus by operation of a user, and the CPU circuit portion 150 can acquire and recognize those sheet conditions. The sheet conditions include, other than the sheet size, physical properties (surface properties) such as the stiffness, the thickness, the grammage, the surface resistance, and the smoothness, and a sheet kind such as punched paper, and tab paper.

Moreover, the control portion may be provided in any one of the sheet processing apparatus (center-binding book-forming portion 800), the finisher 500, and the main body of the apparatus (printing portion 300).

(Holding unit 11 in center-binding book-forming portion 800 and conveying operation of a sheet)

Then, the holding unit 11 in a center-binding book-forming portion 800 and conveying operation of a sheet are described using FIG. 8, FIG. 9, and FIG. 12.

As illustrated in FIG. 12, classification processing of a sheet size is performed first (S1). Based on a classified sheet size, the sheet positioning member 805 is moved to a position corresponding to the size (S2). The holding unit 11 is moved according to the trailing end position of a stacked sheet (S3). The sheet holding unit 11 is moved to the sheet holding position (S4).

Figure 8A:
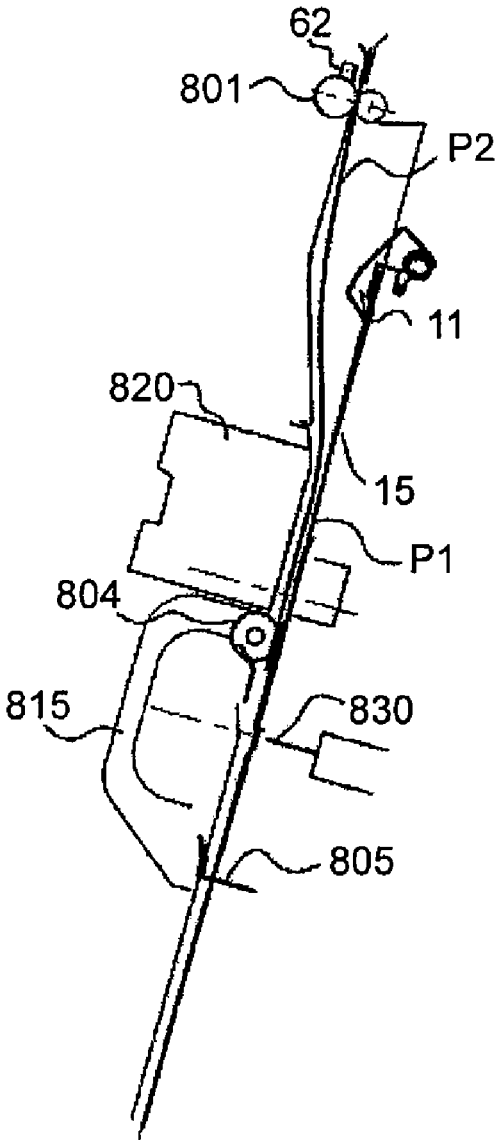
FIG. 8A and FIG. 8B are operation explanatory diagrams illustrating sheet conveying states.

As illustrated in FIG. 8A, the subsequent sheet P2 is delivered from the pair of saddle entrance rollers 801 to the conveying roller 804 (S5). In this case, the trailing end portion of the preceding sheet P1 stacked on the sheet stacking surface 15 of the storage guide 803 is held by the holding unit 11.

Figure 8B:
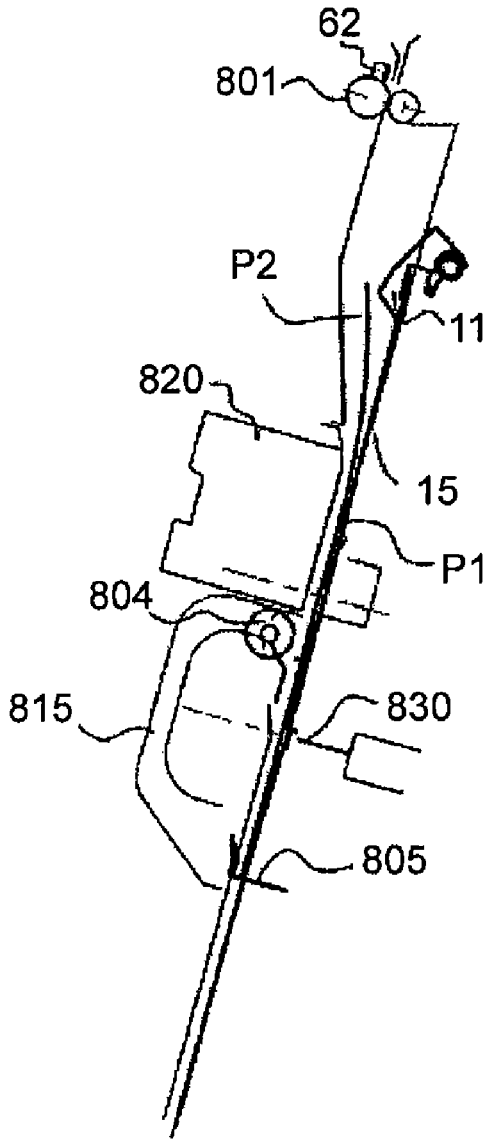

As illustrated in FIG. 8B, the subsequent sheet P2 is conveyed by the conveying roller 804, and the tip end of the sheet is conveyed to the vicinity of the sheet positioning member (tip end stopper) 805. Then, the conveying roller 804 is separated from the subsequent sheet P2.

Figure 9A:
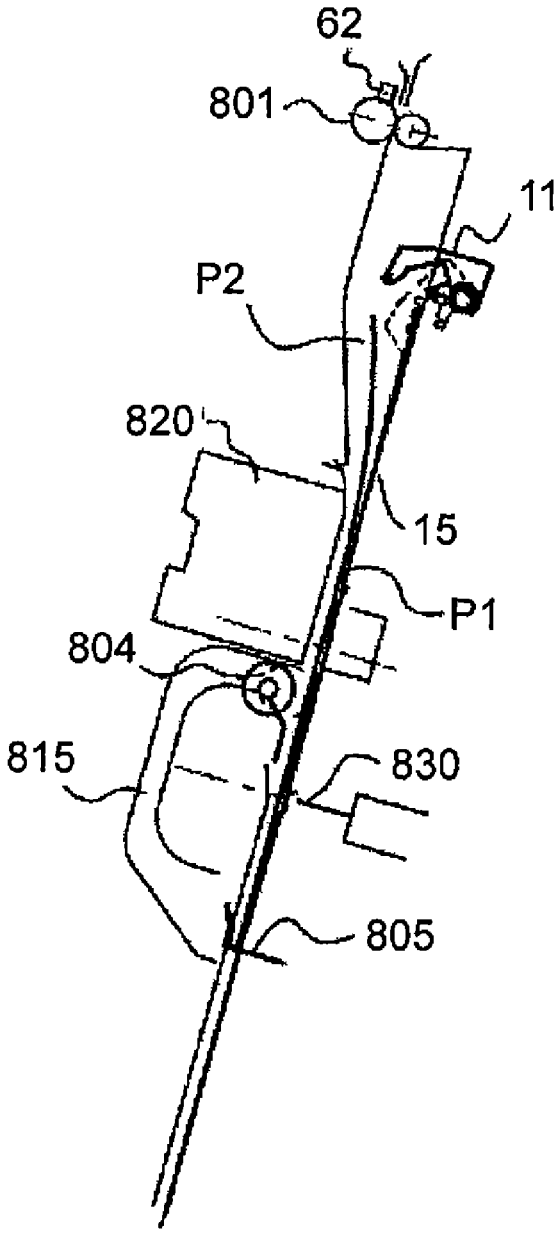
FIG. 9A and FIG. 9B are operation explanatory diagrams illustrating sheet conveying states.

As illustrated in FIG. 9A, the conveying roller 804 is separated from the subsequent sheet P2, and, then, the holding unit 11 is rotated to the retracting position (S6). Under such a condition, alignment operations are performed in the sheet conveying direction and the orthogonal direction by the pair of alignment boards 815 (S7). Operations S4 through S7 are repeated till the alignment of the final sheet is completed (S8).

Figure 9B:
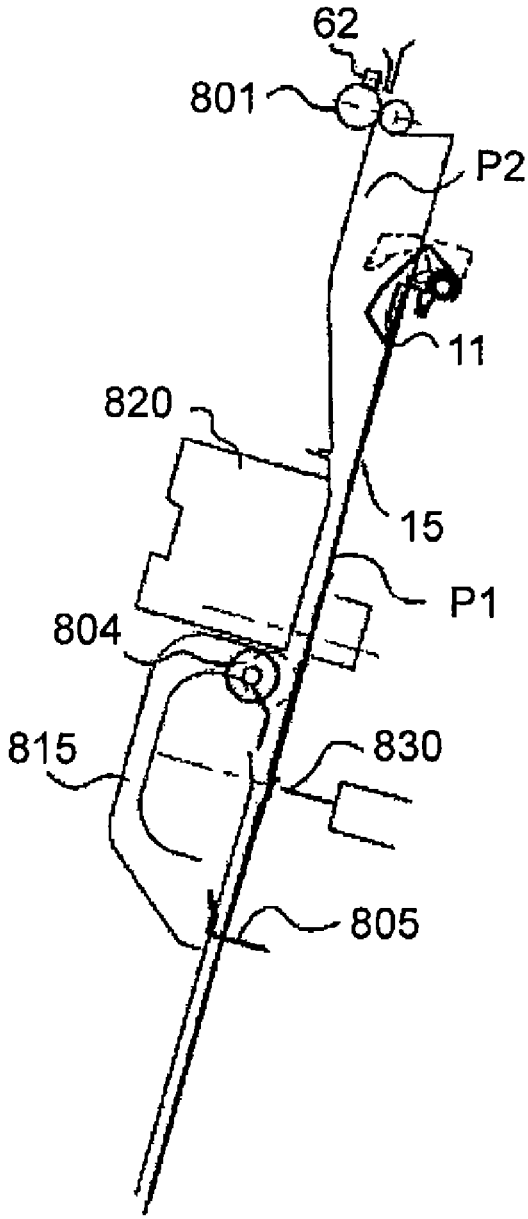

As illustrated in FIG. 9B, the holding unit 11 is rotated to the holding position after completion of the alignment operation, and the trailing end portion of the subsequent sheet P2 is held. By the operation, the sheets are stacked from the first piece to a predetermined piece of sheets.

Figure 6A:
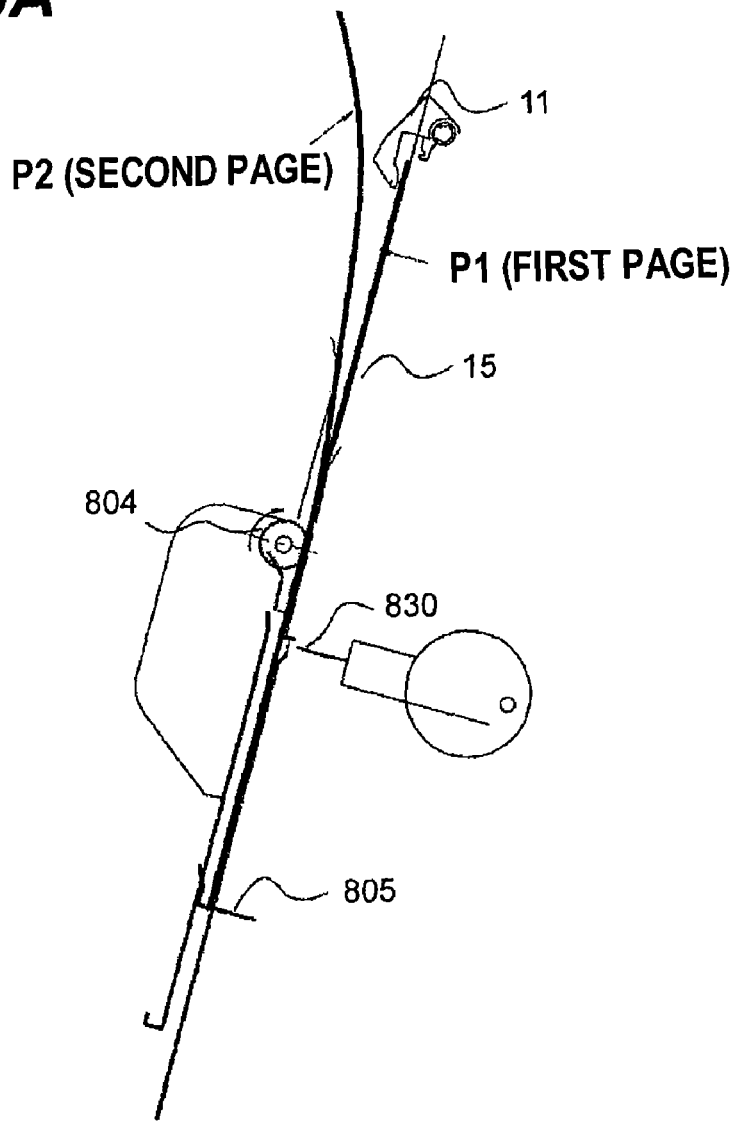
FIG. 6A and FIG. 6B are diagrams for explaining an effect of the sheet processing apparatus.
Figure 6B:
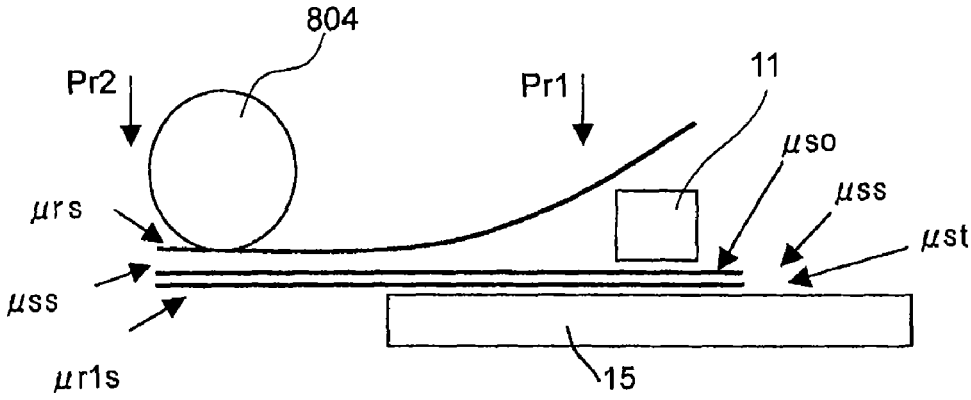

By the above operations, the preceding sheet P1 which has already been stacked is held by the holding unit 11 as illustrated in FIG. 6, while the subsequent sheet P2 is conveyed by the conveying roller 804. Therefore, the preceding sheet P1 can be conveyed together with the subsequent sheet P2, and buckling can be controlled.

The sheet bundle in which the final sheet is aligned is stapled by the stapler 820 (S9). Subsequently, the sheet bundle detects whether the bundle is located at the folding position (S10). When a sheet bundle is not at the folding position, the sheet positioning member 805 is moved to the folding position, and the sheet bundle is moved to the folding position (S11).

When the sheet bundle is at the folding position, the folding processing is performed by the extruding member 830, and the pair of folding rollers 810 (S12). Then, the crease reinforcement processing is performed by the crease press unit 860 (S13). The sheet bundle after the crease reinforcement processing is discharged to a discharge tray 843 (S14).

When the discharging of the final sheet bundle is completed, the job is completed (S15 and S16). When the discharging of the final sheet bundle is not completed, the processing returns to S4 (S15).

It is desirable that the relations among a holding pressure Pr1 of the holding unit 11, a roller pressure (conveying pressure) Pr2 of the conveying roller 804, and a friction coefficient μ between the roller and the sheet to be conveyed satisfy the following expressions as illustrated in FIG. 6.

When there is one piece of the preceding sheet P1 which has already been stacked, Pr1>μss Pr2/(μso+μst), when the number of the proceeding sheets P1 is 2 or more, Pr1>μss Pr2/(μso+μss).

Pr1: holding pressure by the holding unit 11

Pr2: roller pressure (conveying pressure) of the conveying roller 804

μso: friction coefficient between holding unit 11 and paper

μst: friction coefficient between sheet stacking surface 15 and paper

μrs: friction coefficient between conveying roller 804 and paper

μrls: friction coefficient between sub roller (opposing to the conveying roller 804) and paper μss: friction coefficient between paper and paper That is, it is desirable that the holding force (resistance force)of the holding unit 11 is set to be larger than the conveying force of the conveying roller 804. For example, it is preferable that a high-friction member such as rubber is provided on the holding surface of the holding unit 11.

(Effects)

Defective conveying and defective alignment can be controlled by providing the holding unit 11 which holds the upstream end of a sheet in the discharging direction. The defective conveying and the defective alignment are generated when an inelastic sheet is aligned and stacked, and a sheet which has already been stacked is conveyed together with a sheet which is subsequently conveyed, and sheets cause buckling. Therefore, various kinds of sheets such as inelastic sheets can be processed without defective conveying and defective alignment.

While defective conveying and defective alignment are controlled, the smaller size of an apparatus can be realized by a configuration in which the holding unit 11 is provided and the storage guide 803 is approximately inclined vertically. Therefore, an apparatus with a smaller installing area can be realized.

Second Embodiment

Next, a sheet stacking apparatus, a sheet processing apparatus, and an image forming apparatus according to a second embodiment of the present invention is described using drawings. Similar portions in the description to those of the first embodiment are denoted by the same reference numerals, and the description will not be described herein.

As illustrated in FIG. 13, the sheet stacking apparatus, the sheet processing apparatus, and the image forming apparatus in the present embodiment are obtained by adding a beating member 16 to the sheet stacking apparatus, the sheet processing apparatus, and the image forming apparatus according to the first embodiment. The beating member 16 can be moved in the vertical direction to a sheet stacking surface 15 by a not-shown driving source.

A holding unit 11 and a beating member 16 in a center-binding book-forming portion 800 and conveying operation of a sheet are described.

Figure 13A:
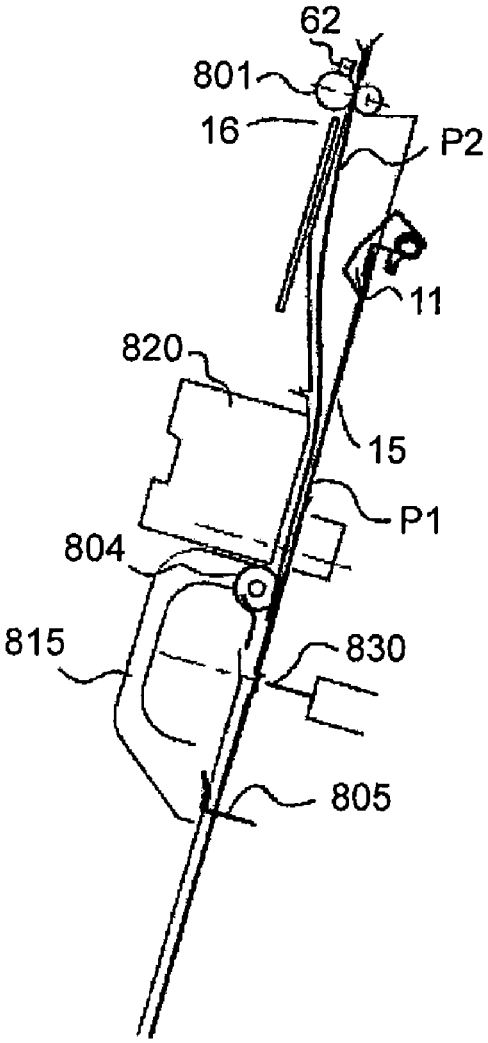
FIG. 13A and FIG. 13B are operation explanatory diagrams of a sheet processing apparatus according to a second embodiment.

As illustrated in FIG. 13A, the subsequent sheet P2 is delivered from a pair of saddle entrance rollers 801 to a conveying roller 804. In this case, the trailing end portion of the preceding sheet P1 stacked on a sheet stacking surface 15 of a storage guide 803 is held by a holding unit 11.

Figure 13B:
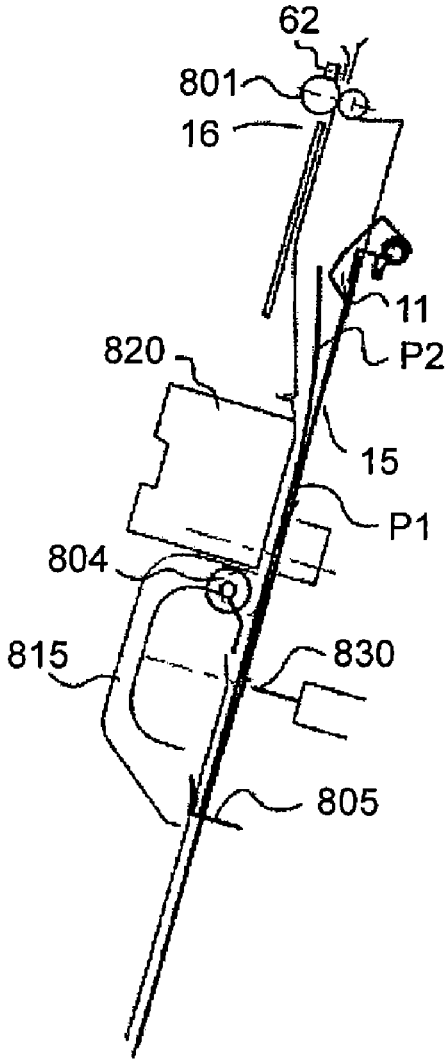

As illustrated in FIG. 13B the subsequent sheet P2 is conveyed by a conveying roller 804, and the tip end of the subsequent sheet P2 is conveyed to the vicinity of a sheet positioning member 805. Then, the conveying roller 804 is separated from the sheet P2.

Figure 14A:
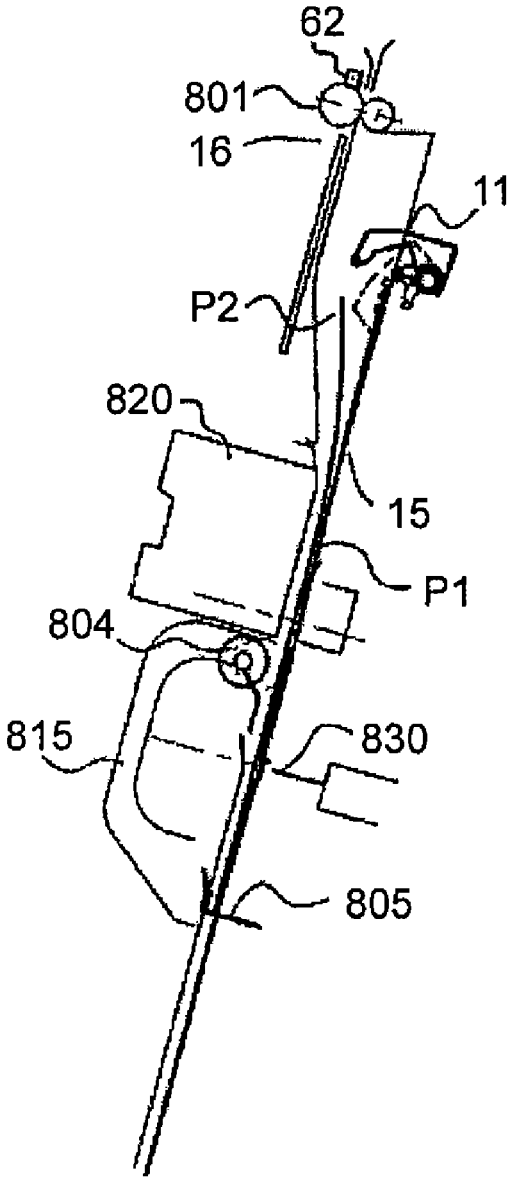
FIG. 14A and FIG. 14B are operation explanatory diagrams of the sheet processing apparatus according to the second embodiment.

As illustrated in FIG. 14A, the holding unit 11 is rotated to a retracting position after the conveying roller 804 is separated from the sheet P2. At this time, an alignment operation is performed in the sheet conveying direction and the orthogonal direction by a pair of alignment boards 815.

Figure 14B:
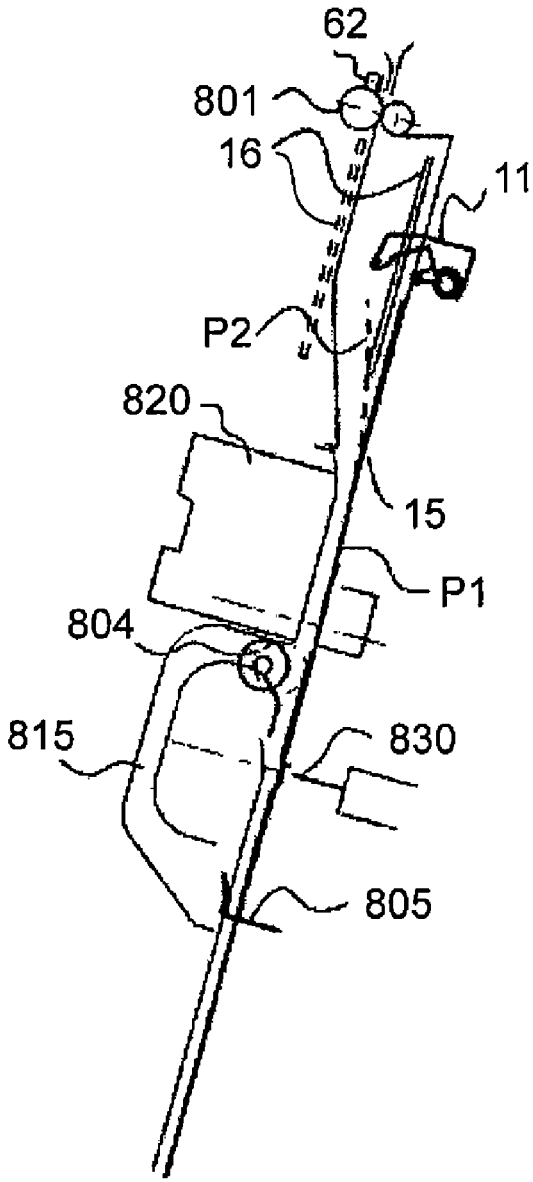
Figure 15A:
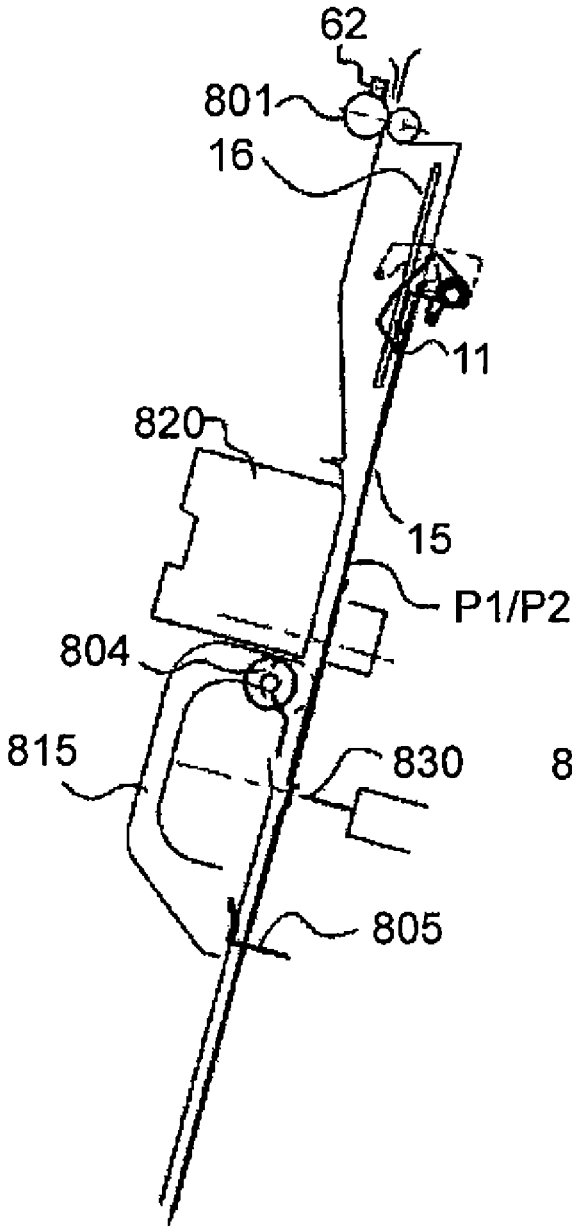
FIG. 15A and FIG. 15B are operation explanatory diagrams of the sheet processing apparatus according to the second embodiment.
Figure 15B:
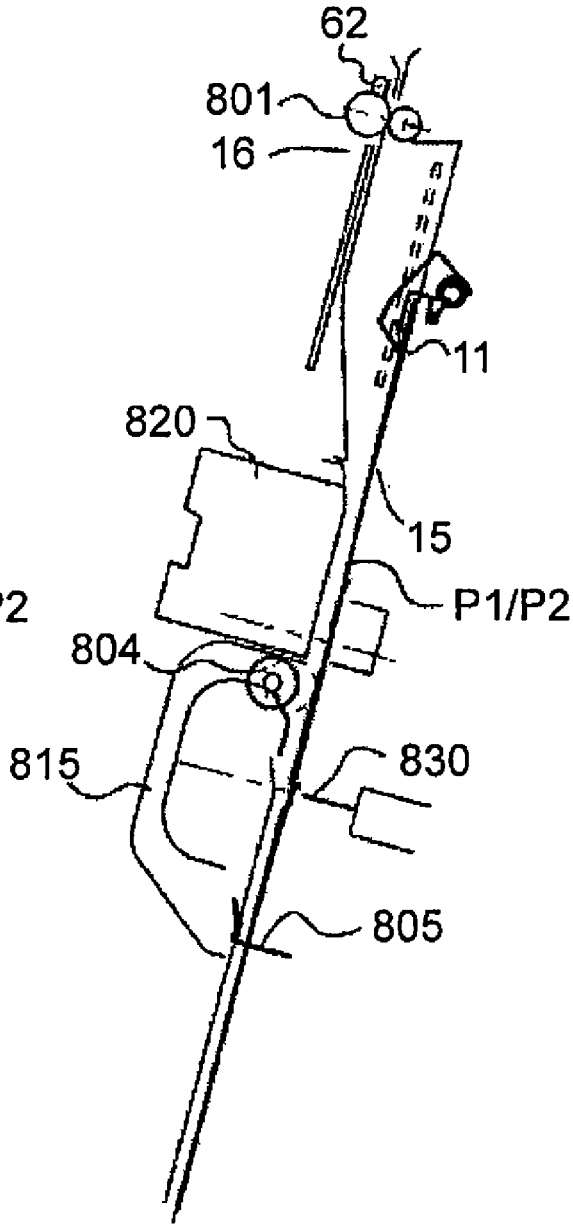
Figure 16:
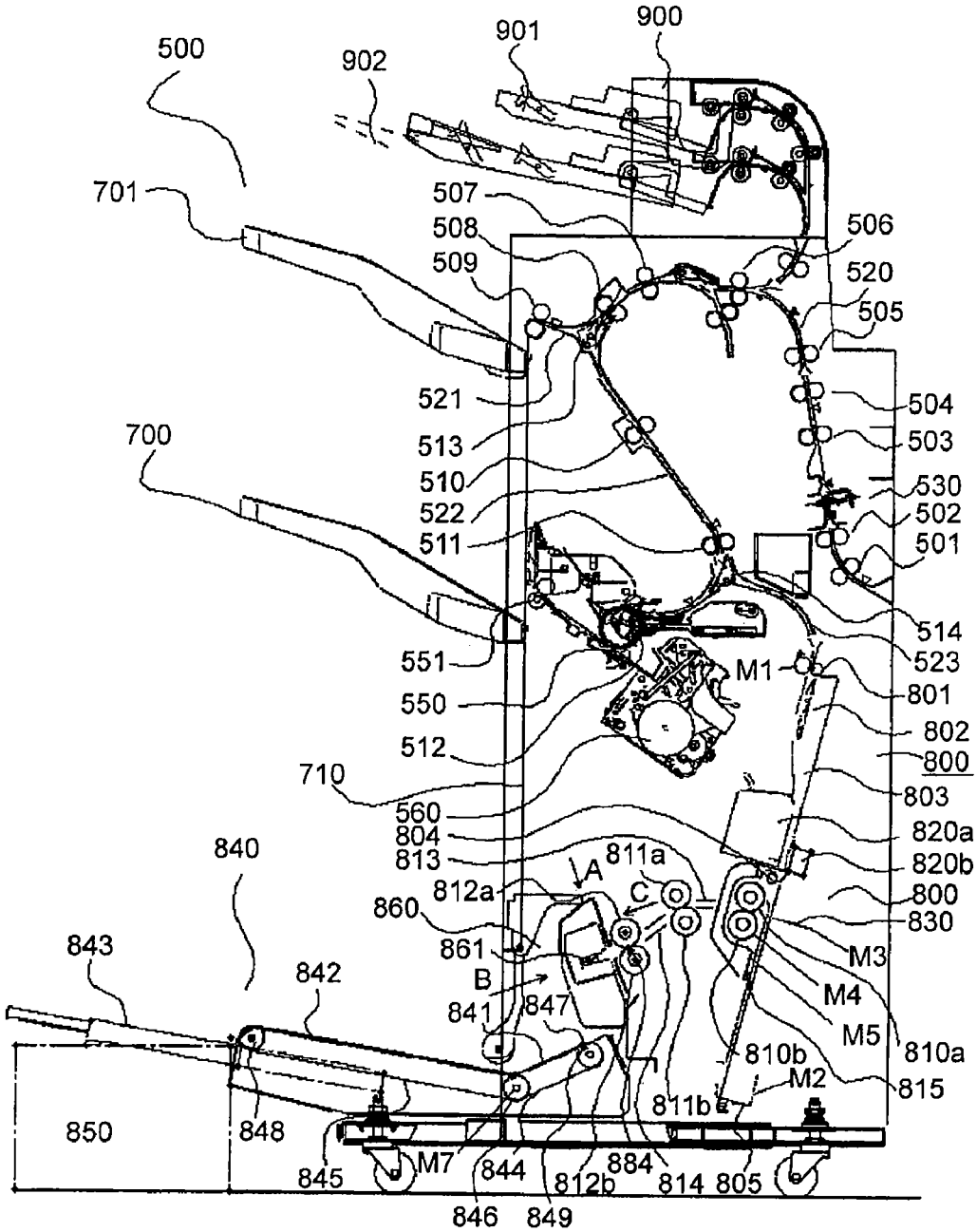
FIG. 16 PRIOR ART
FIG. 16 is a configuration diagram of a conventional sheet processing apparatus.
Figure 17:
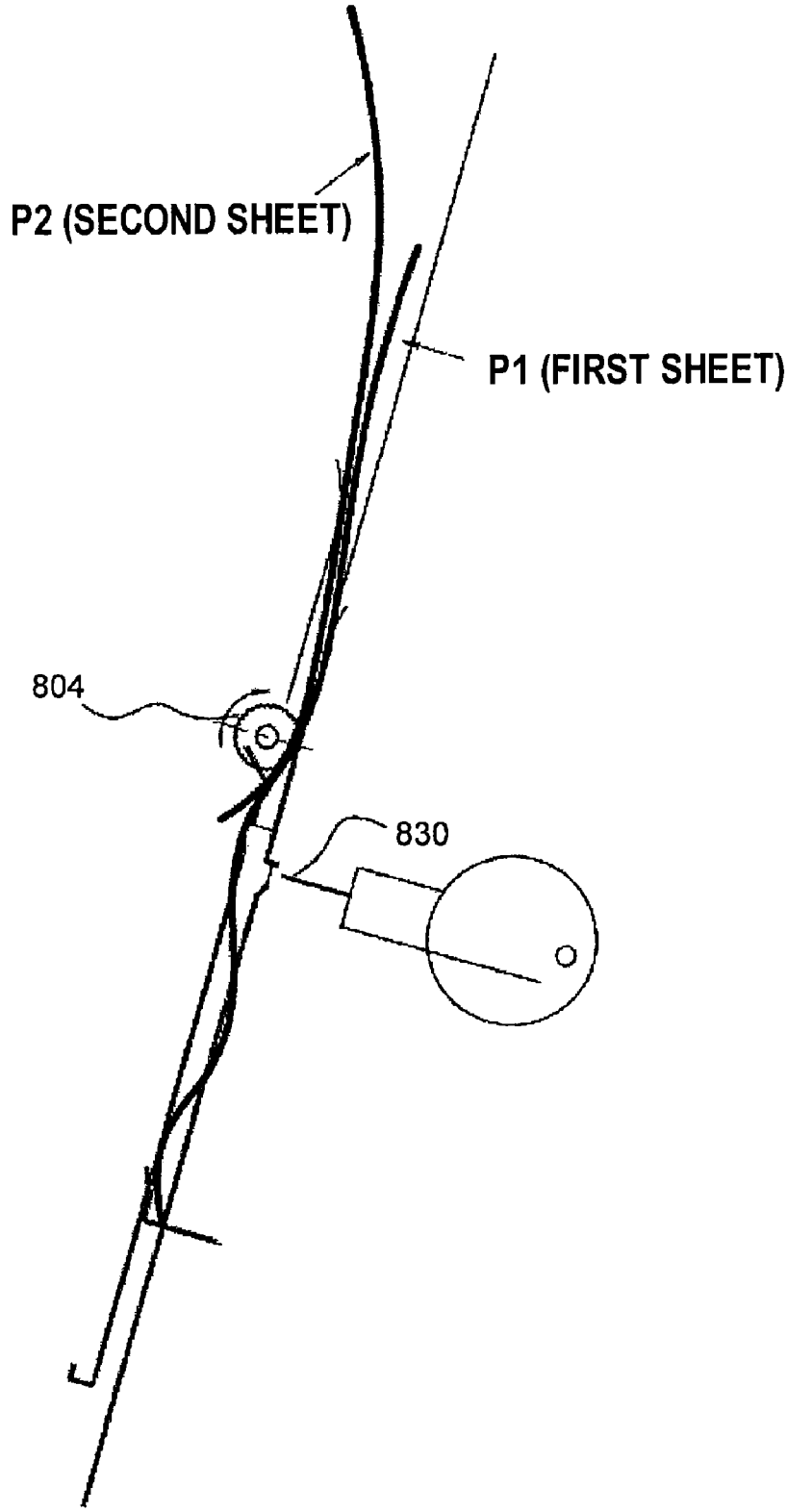
FIG. 17 PRIOR ART
FIG. 17 is an operation explanatory diagram of the conventional sheet processing apparatus.

As illustrated in FIG. 14B, the beating member 16 is moved in a direction approaching the sheet stacking surface 15, and the sheet P2 is held against the sheet stacking surface 15. As illustrated in FIG. 15A, the holding unit 11 is rotated to the holding position while the sheet is held against the beating member 16, and the trailing end portion of the sheet P2 is held. As illustrated in FIG. 15B, the beating member 16 is moved to a standby position.

The sheets are stacked from the first sheet to the predetermined number of sheets by the operation.

As the sheet holding unit 11 is configured to hold the trailing end of the subsequent sheet P2 in a state that the subsequent sheet P2 is held by a beating member 16, the subsequent sheet P2 can be reliably held even when the trailing end of the subsequent sheet P2 is curled. Moreover, even when inelastic sheets such as thin papers are folded by their own weights, sheet stacking alignment can be more reliably realized on an approximately-vertical tray because the inelastic sheet can be held after the sheet is extended straight.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-299898, filed Nov. 19, 2007, which is hereby incorporated by reference herein in its entirety.

What is claimed is:

1. A sheet stacking apparatus comprising:

a discharging unit which discharges a sheet;

a stacking member which stacks the sheet discharged by the discharging unit; and a holding unit which is movably disposed along a stacking surface of the stacking member and holds the upstream end in the discharging direction of the stacked sheet;

wherein the holding unit is moved according to changes in the upstream end position of the stacked sheet in the discharging direction, and the holding unit holds the upstream end of the stacked sheet until another sheet is discharged so as not to move the stacked sheet while the other sheet is being discharged by the discharging unit.

2. The sheet stacking apparatus according to claim 1, wherein the stacking member is inclined in such a way that the downstream side in the discharging direction is lowered.

3. The sheet stacking apparatus according to claim 1, further comprising:

a sheet positioning member which receives the downstream end in the discharging direction of the sheet discharged from the discharging unit; and a conveying unit which conveys the sheet toward the sheet positioning member;

wherein, when the conveying unit conveys the discharged sheet, the holding unit holds the upstream end in the discharging direction of the sheet which is already caught by the sheet positioning member.

4. The sheet stacking apparatus according to claim 1, wherein the holding unit has a sheet holding surface holding the stacked sheet and a sheet guide surface guiding the discharged sheet.

5. A sheet processing apparatus comprising:

a discharging unit which discharges a sheet;

a stacking member which stacks the sheet discharged by the discharging unit;

a holding unit which is movably disposed along a stacking surface of the stacking member and holds the upstream end in the discharging direction of the stacked sheet; and a processing unit which processes sheets stacked in the stacking member;

wherein the holding unit is moved according to changes in the upstream end position of the stacked sheet in the discharging direction, and the holding unit holds the upstream end of the stacked sheet until another sheet is discharged so as not to move the stacked sheet while the other sheet is being discharged by the discharging unit.

6. The sheet processing apparatus according to claim 5 further comprising, a sheet positioning member which can be moved along the stacking surface of the stacking member in such a way that processing is executed by the processing unit at a predetermined processing position on sheets.

7. The sheet processing apparatus according to claim 5, wherein the stacking member is inclined in such a way that the downstream side in the discharging direction is lowered.

8. The sheet processing apparatus according to claim 5, further comprising:

a sheet positioning member which receives the downstream end in the discharging direction of the sheet discharged from the discharging unit; and a conveying unit which conveys the sheet toward the sheet positioning member;

wherein, when the conveying unit conveys the discharged sheet, the holding unit holds the upstream end in the discharging direction of the sheet which is already caught by the sheet positioning member.

9. The sheet processing apparatus according to claim 5, wherein the holding unit includes a sheet holding surface holding the stacked sheet and a sheet guide surface guiding the discharged sheet.

10. An image forming apparatus comprising:

an image forming unit which forms an image on a sheet; and a discharging unit which discharges the sheet;

a stacking member which stacks the sheet discharged by the discharging unit, on which an image is formed by the image forming unit; and a holding unit which is movably disposed along a stacking surface of the stacking member and holds the upstream end in the discharging direction of the stacked sheet;

wherein the holding unit is moved according to changes in the upstream end position of the stacked sheet in the discharging direction, and the holding unit holds the upstream end of the stacked sheet until another sheet is discharged so as not to move the stacked sheet while the other sheet is being discharged by the discharging unit.

11. The image forming apparatus according to claim 10, further comprising:

a processing unit which processes sheets stacked in the stacking member.

12. The image forming apparatus according to claim 11 further comprising, a sheet positioning member which can be moved along the stacking surface of the stacking member in such way that processing is executed by the processing unit at a predetermined processing position on sheets.

13. The image forming apparatus according to claim 10, wherein the stacking member is inclined in such a way that the downstream side in the discharging direction is lowered.

14. The image forming apparatus according to claim 10, further comprising:

a sheet positioning member which receives the downstream end in the discharging direction of the sheet discharged from the discharging unit; and a conveying unit which conveys the sheet toward the sheet positioning member;

wherein, when the conveying unit conveys the discharged sheet, the holding unit holds the upstream end in the discharging direction of the sheet which is already caught by the sheet positioning member.

15. The image forming apparatus according to claim 10, wherein the holding unit has a sheet holding surface holding the stacked sheet and a sheet guide surface guiding the discharged sheet.

16. The sheet stacking apparatus according to claim 1, wherein the holding unit is disposed at the stacking surface side of the stacking member.

17. The sheet processing apparatus according to claim 5, wherein the holding unit is disposed at the stacking surface side of the stacking member.

18. The image forming apparatus according to claim 10, wherein the holding unit is disposed at the stacking surface side of the stacking member.

* * * * *